US009144354B2

(12) United States Patent
Yang

(10) Patent No.: US 9,144,354 B2
(45) Date of Patent: Sep. 29, 2015

(54) LIFT-OFF HINGE WITH ATTACHED HINGE COVER

(75) Inventor: Mingchang Yang, Xaimen (CN)

(73) Assignee: WDI INTERNATIONAL, INC, Irvine, CA (US)

( * ) Notice: Subject to any disclaimer, the term of this patent is extended or adjusted under 35 U.S.C. 154(b) by 711 days.

(21) Appl. No.: 13/477,403

(22) Filed: May 22, 2012

(65) Prior Publication Data

US 2013/0312171 A1 Nov. 28, 2013

(51) Int. Cl.
*A47K 13/12* (2006.01)
*A47K 13/26* (2006.01)

(52) U.S. Cl.
CPC ..... *A47K 13/26* (2013.01)

(58) Field of Classification Search
CPC ..... A47K 13/12
USPC ..... 4/240, 237
See application file for complete search history.

(56) References Cited

U.S. PATENT DOCUMENTS

| | | | | |
|---|---|---|---|---|
| 7,281,276 | B2 * | 10/2007 | Vierkant et al. | 4/240 |
| 7,827,626 | B2 * | 11/2010 | Zhou | 4/236 |
| 2006/0064807 | A1 * | 3/2006 | Vierkant, III | 4/236 |
| 2009/0113610 | A1 * | 5/2009 | Lin et al. | 4/240 |

* cited by examiner

*Primary Examiner* — Huyen Le
(74) *Attorney, Agent, or Firm* — Maribeth Meluch

(57) ABSTRACT

A lift-off toilet seat includes a hinge body for pivotably supporting a toilet seat and a mounting block having a slot therethrough for enabling positionable attachment of the block to a toilet seat via a bolt. A buckle extends from the hinge body and slidably engages sides of the block with the block having a top opening for enabling both the bolt to pass therethrough and positioning of the block on the toilet bowl together with the hinge body and toilet seat. A cover, hinged to the buckle is provided for covering the buckle and locking the buckle to the block.

17 Claims, 2 Drawing Sheets

LIFT-OFF HINGE WITH ATTACHED HINGE COVER

The present invention relates to a hinge mechanism for detachably securing a toilet seat to a toilet bowl and is more particularly directed to a toilet seat hinge, which facilitates ready removal of the seat from the toilet bowl to enable toilet bowl and toilet seat cleaning.

Most toilet seats are secured to a toilet bowl by way of bolt, which inhibits proper cleaning of the toilet bowl proximate the hinge-toilet bowl interface.

The bolts are prone to both becoming soiled and frozen by corrosion and access thereto is often difficult.

The present invention provides for an improved lift-off hinge, which provides secure fastening of a toilet seat to a toilet bowl, as well as being attractive. In addition, the present invention provides the feature of enabling adjustable positioning of the toilet seat on a toilet bowl.

SUMMARY OF THE INVENTION

A lift-off toilet seat hinge in accordance with the present invention generally includes a hinge body for pivotably supporting a toilet seat along with a mounting block having a slot therethrough for enabling positionable attachment of the block to a toilet bowl through the use of a bolt. That is, the slot enables adjustment of the mounting block on the toilet bowl.

A buckle is provided which extends from the hinge body for slidably engaging sides of the block. The buckle also includes a top opening for enabling both the bolt to pass therethrough and positioning of the block on the toilet bowl together with the hinge body and toilet seat.

When coupled to the bolt, the buckle is movable therewith during installation thereby enabling alignment of the toilet seat, and front edge thereof, with a toilet bowl. This provides a more custom look than is available by hereinbefore utilized lift-off toilet seat hinges.

A cover is provided which is hinged to the buckle for covering the buckle and locking the buckle to the block subsequent to tightening of the bolt for fixing the block to the toilet bowl.

More particularly the cover may include a depending member sized and oriented for engaging the block upon closure of the cover onto the buckle and block in order to effect a locking between the buckle and the block and concomitantly the toilet seat to the bowl by preventing sliding disengagement between the buckle and the block.

More specifically, in accordance with the present invention, the hinge may include rails on opposite side thereof and the buckle may include channels on opposite sides thereof for enabling a slidable engagement between the buckle and the block.

Still more particularly, the hinge in accordance with the present invention may include a cover including a depending front member sized and oriented to engage a back side of the block upon closure of the cover onto the buckle in order to further effect latching between the buckle and the block.

In addition, the block back side may include a berm for engaging the cover depending front member and a frontal tab on the cover may be provided for facilitating opening of said cover by finger manipulation.

BRIEF DESCRIPTION OF THE DRAWINGS

The advantages and features of the present invention will be better understood by the following description when considered in conjunction with the accompanying drawings in which.

DETAILED DESCRIPTION

Figure 1:
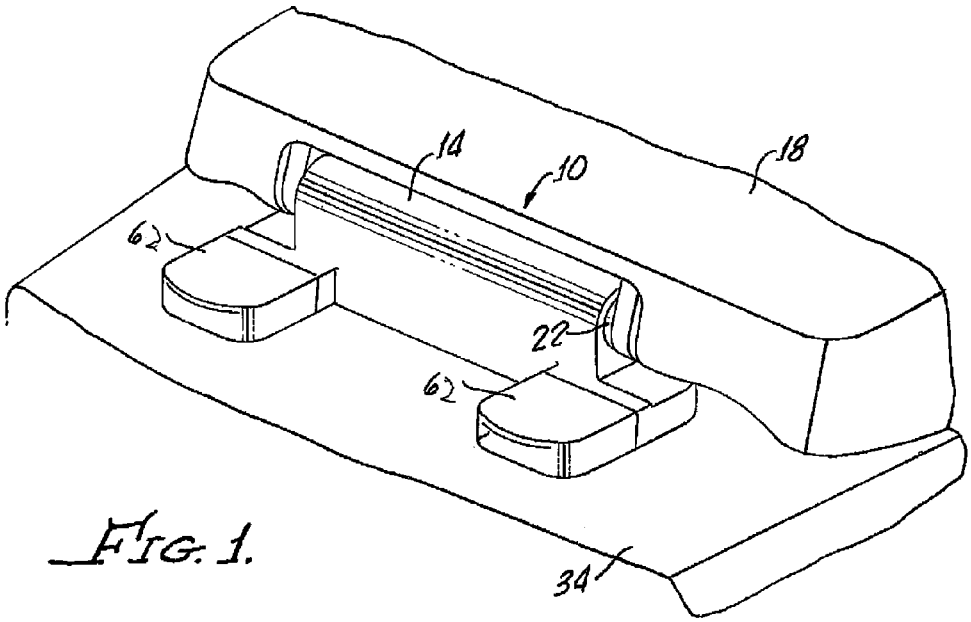
FIG. 1 is a perspective view of a lift-off toilet seat hinge as it may be installed on a toilet bowl for pivotally supporting a toilet seat.
Figure 2:
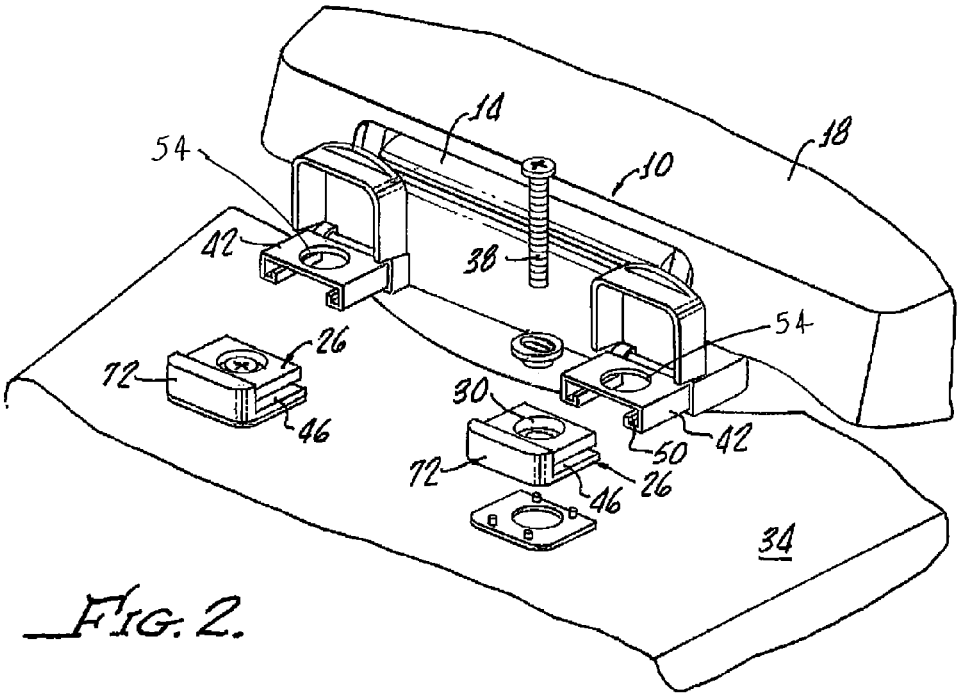
FIG. 2 is a perspective exploded view of the hinge in accordance with the present invention shown in a disengaged position with a hinge body having at least one buckle for engaging a block attached to the toilet bowl along with a hinged cover for locking the buckle to the block.
Figure 3:
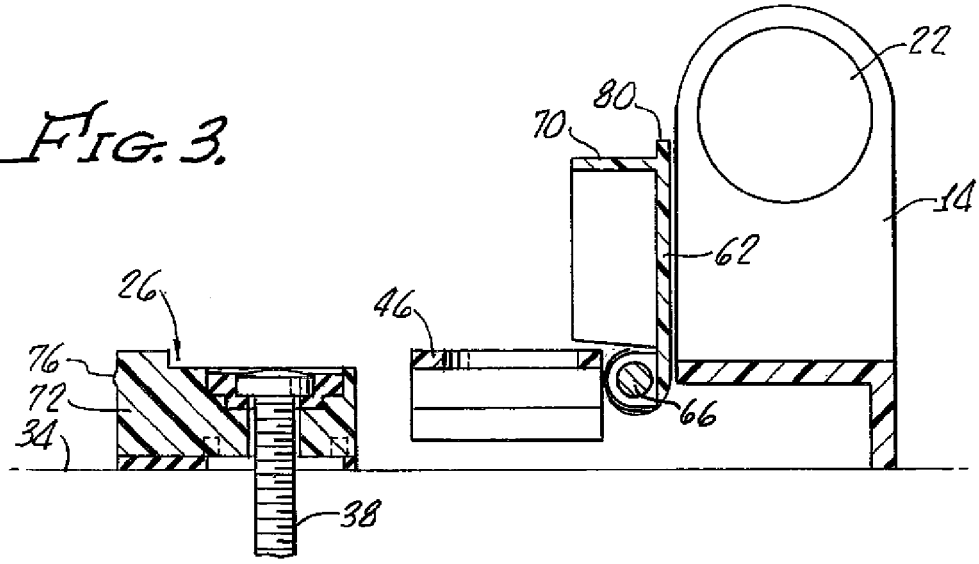
FIG. 3 is a cross sectional view of one of the buckles and hinge shown in FIG. 2.

With reference to FIGS. 1 and 2, there is shown a lift-off toilet seat hinge 10 in accordance with the present invention generally including a hinge body 14 pivotally supporting a toilet seat 18 by way of a hinge 22.

A mounting block 26 includes a slot 30 therethrough for enabling positionable attachment of the block 26 to a toilet bowl 34 by means of a bolt 38, see FIGS. 2-5.

Figure 5:
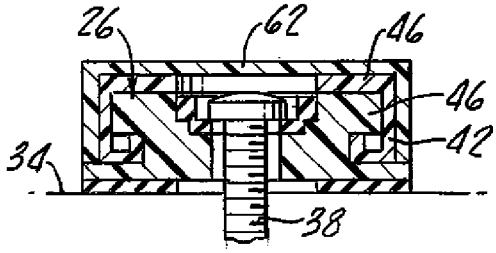
FIG. 5 is a cross sectional view taken along the line 5-5 of FIG. 4 illustrating rails and channels in the block and buckle respectively for enabling sliding engagement therebetween.

Buckles 42 extending from the hinge body 14, are provided for slidably engaging block side rails 46 by way of channels 50 as best shown in FIG. 5.

Again, with reference to FIG. 2, each buckle 42 includes a top opening 54, which is aligned with the buckle slot 30 for enabling the bolt 38 to pass therethrough and before tightening of the bolt to secure the block 26 to the bolt 34 positioning, or adjustment, of the buckle as well as the hinge and toilet seat may be moved as indicated by the arrows 58 (FIG. 4) in order to adjust a lateral position of the hinge and toilet seat on the bowl 34 before tightening of the bolt 38 to affix the block 26 to the bowl 34.

This enables alignment of a toilet seat front edge (not shown) with toilet bowl front edge (also not shown). This feature enables proper positioning of the toilet seat 18 on the bowl 34 for both utile and aesthetic purposes. The movement indicated by the arrows 58 in FIG. 4 is not to scale but illustrated to demonstrate this feature of the present invention.

Figure 4:
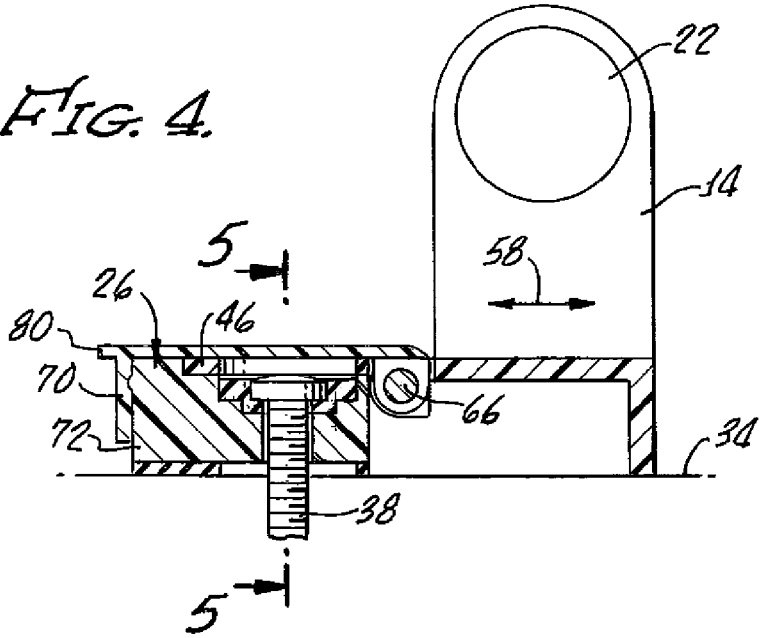
FIG. 4 illustrates the hinge body and buckle couple with the bolt along with a bolt fastening the block to a toilet bowl and illustrating a slot in the bolt and an opening of the buckle which enables positioning of the block buckle and a hinge along with the toilet seat on the toilet bowl as illustrated by arrows.

Covers 62 hinged to the buckles 42 by way of pins 66 are provided for covering the buckles 42 and blocks 26, as illustrated in FIGS. 1, 4, and 5, and also provide for locking of the buckles 42 to the blocks 26.

This locking arrangement is provided by depending member 70 sized and shaped for engaging a back side 72 of the blocks 26.

In addition, locking is further provided by berm 76 on the back block side 72 which engages the lip member to insure locking of the buckle 42 to the mounting block 26 as is illustrated in FIGS. 4 and 5. A frontal tab 80 facilitate opening of the cover 62 by enabling a finger (not shown) access thereto.

Once the cover is open, the buckles 42, as well as the hinge 10 and seat 18 are easily removed from the toilet bowl 34.

Although there has been hereinabove described a lift-off hinge having positioning block with attached hinge cover assembly in accordance with the present invention for the purpose of illustrating the manner in which the invention may be used to advantage, it should be appreciated that the invention is not limited thereto. That is, the present invention may suitably comprise, consist of or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A lift-off toilet seat hinge comprising:

a hinge body for pivotably supporting a toilet seat;

a mounting block having a slot therethrough for enabling positionable attachment of the block to a toilet bowl via a bolt;

a buckle, extending from said hinge for slidably engaging sides of the block, said buckle having a top opening for enabling both the bolt to pass therethrough and positioning of the block on the toilet bowl together with the hinge body and toilet seat, wherein the hinge is configured such that when the buckle is operatively coupled to the bolt, the buckle is laterally movable to enable the hinge body and the toilet seat to laterally move together relative to the toilet bowl to a plurality of lateral positions before the bolt is tightened to affix the block to the bowl; and a cover, hinged to the buckle, for covering the block and locking said buckle to the block.

2. The hinge according to claim 1 wherein said cover includes a depending member sized and oriented to engage the block upon closure of said cover onto said buckle in order to effect locking between said buckle and the block and prevent sliding disengagement therebetween.

3. The hinge according to claim 2 wherein said cover includes a depending front member sized and oriented to engage a back side of the block upon closure of said cover onto said block in order to effect locking between said buckle and the block.

4. The hinge according to claim 2 wherein the block includes rails on opposite sides thereof and said buckle includes channels on opposite sides thereof for enabling slidable engagement between said buckle and the block.

5. The hinge according to claim 1 wherein said buckle is configured for slidably engaging sides of the block via lateral movement of said buckle relative to the block.

6. The hinge according to claim 5 wherein said block includes rails on opposite sides thereof and said buckle includes channels on opposite sides thereof for enabling slidable engagement between said rails and said channels via lateral movement of said buckle relative to said block, wherein the hinge is configured such that said rails and said channels extend linearly in the forward and rearward direction relative to the toilet bowl when said block is positioned on said toilet bowl and said buckle slidably engages said block.

7. The hinge according to claim 1, wherein one of the lateral positions is such that a front edge of the toilet seat is aligned with a front edge of the toilet bowl.

8. A lift-off toilet seat hinge comprising:

a hinge body for pivotably supporting a toilet seat;

a mounting block having a slot therethrough for enabling positionable attachment of the block to a toilet bowl via a bolt;

a buckle, extending from said hinge for slidably engaging sides of the block, said buckle having a top opening for enabling both the bolt to pass therethrough and positioning of the block on the toilet bowl together with the hinge body and toilet seat; and a cover, hinged to the buckle, for covering the block and locking said buckle to the block, wherein said cover includes a depending member sized and oriented to engage the block upon closure of said cover onto said buckle in order to effect locking between said buckle and the block and prevent sliding disengagement therebetween, wherein said cover includes a depending front member sized and oriented to engage a back side of the block upon closure of said cover onto said block in order to effect locking between said buckle and the block, wherein the block back side includes a berm for engaging the cover depending front member.

9. The hinge according to claim 8 wherein said cover includes a frontal tab for facilitating opening of said cover by enabling finger access to the cover.

10. A lift-off toilet seat hinge comprising:

a hinge body for pivotably supporting a toilet seat;

a pair of mounting blocks each having a slot therethrough for enabling positionable attachment of each block to a toilet bowl via corresponding bolts;

a pair of buckles, each extending from said hinge body for slidably engaging corresponding sides of corresponding blocks, each buckle having a top opening for enabling both the corresponding bolt to pass therethrough and positioning of the corresponding blocks on the toilet bowl together with the hinge body and toilet seat, wherein the hinge is configured such that when the buckles are operatively coupled to their corresponding bolts, the buckles are laterally movable to enable the hinge body and the toilet seat to laterally move together relative to the toilet bowl to a plurality of lateral positions before the bolts are tightened to affix the blocks to the bowl; and a pair of covers, each hinged to a corresponding buckle, for covering the corresponding buckle and locking the corresponding buckle to the corresponding block.

11. The hinge according to claim 10 wherein each buckle includes a notch and each cover includes a depending member sized and oriented to engage a corresponding block upon closure of each cover onto the corresponding block in order to effect locking between each buckle and each block to prevent sliding disengagement therebetween.

12. The hinge according to claim 11 wherein each block includes rails on opposite sides thereof and each corresponding buckle includes channels on opposite sides thereof for enabling slidable engagement between corresponding buckles and blocks.

13. The hinge according to claim 12 wherein each cover includes a depending front member sized and oriented to engage a corresponding buckle side of each block upon closure of each cover onto each corresponding block in order to effect locking between corresponding buckles and blocks.

14. The hinge according to claim 10 wherein each of said buckles is configured for slidably engaging corresponding sides of the corresponding block via lateral movement of said buckle relative to said block.

15. The hinge according to claim 14 wherein each of said blocks includes rails on opposite sides thereof and each of said buckle includes channels on opposite sides thereof for enabling slidable engagement between said rails and said channels via lateral movement of said buckles relative to said blocks, wherein the hinge is configured such that said rails and said channels extend linearly in the forward and rearward direction relative to the toilet bowl when said blocks are positioned on said toilet bowl and said buckles slidably engage said blocks.

16. The hinge according to claim 10, wherein one of the lateral positions is such that a front edge of the toilet seat is aligned with a front edge of the toilet bowl.

17. A lift-off toilet seat hinge comprising:

a hinge body for pivotably supporting a toilet seat;

a pair of mounting blocks each having a slot therethrough for enabling positionable attachment of each block to a toilet bowl via corresponding bolts;

a pair of buckles, each extending from said hinge body for slidably engaging corresponding sides of corresponding blocks, each buckle having a top opening for enabling both the corresponding bolt to pass therethrough and positioning of the corresponding blocks on the toilet bowl together with the hinge body and toilet seat; and a pair of covers, each hinged to a corresponding buckle, for covering the corresponding buckle and locking the corresponding buckle to the corresponding block, wherein each block includes rails on opposite sides thereof and each corresponding buckle includes channels on opposite sides thereof for enabling slidable engagement between corresponding buckles and blocks, wherein each cover includes a depending front member sized and oriented to engage a corresponding buckle side of each block upon closure of each cover onto each corresponding block in order to effect locking between corresponding buckles and blocks, wherein each block back side includes a berm for engaging corresponding cover depending front lips.

* * * * *